US005769563A

United States Patent [19]

Flynn

[11] Patent Number: 5,769,563

[45] Date of Patent: Jun. 23, 1998

[54] HIGHWAY WARNING DEVICE

[76] Inventor: Gregory Flynn, 8 Avon Way, Brick, N.J. 08724

[21] Appl. No.: 722,865

[22] Filed: Sep. 26, 1996

[51] Int. Cl.[6] ..... E01F 9/06

[52] U.S. Cl. ..... 404/15; 116/63 P

[58] Field of Search ..... 404/15, 16; 116/63 R, 116/63 P

[56] References Cited

U.S. PATENT DOCUMENTS

| | | | |
|---|---|---|---|
| 3,880,537 | 4/1975 | Harris et al. | 404/15 |
| 5,106,226 | 4/1992 | Fanscow et al. | 404/15 |
| 5,295,759 | 3/1994 | Flanders et al. | 404/15 |
| 5,327,850 | 7/1994 | Sly et al. | 404/16 X |
| 5,392,728 | 2/1995 | Speer et al. | 404/16 X |
| 5,515,807 | 5/1996 | Speer et al. | 404/16 X |

FOREIGN PATENT DOCUMENTS

| | | | |
|---|---|---|---|
| 499580 | 1/1954 | Canada | 404/15 |
| 119986 | 9/1984 | European Pat. Off. | 404/15 |
| 2618529 | 11/1977 | Germany | 404/15 |
| 2086967 | 5/1982 | United Kingdom | 404/16 |
| 2104946 | 3/1983 | United Kingdom | 404/16 |

*Primary Examiner*—James Lisehora
*Attorney, Agent, or Firm*—Clifford G. Frayne

[57] ABSTRACT

A highway warning system which is capable of being temporarily secured to the road surface and easily removed from the road surface and provides drivers with an audible and vibration warning when approaching roadway construction sites. The system being a mat or plurality of mats temporarily secured to the road surface, the mat or mat having a wave-like upper surface defined by a series of alternating wave heights and troughs which when contacted by the wheels of a vehicle provide an audible sound as well as a slight vibration thereby warning the approaching driver to be alert.

5 Claims, 2 Drawing Sheets

HIGHWAY WARNING DEVICE

BACKGROUND OF THE INVENTION

1. Field of the Invention

This invention concerns a warning means for alerting a driver of an automotive vehicle of a potentially hazardous driving condition, and in particular, to the fact that construction crews are working on or near the roadway, and more particularly, relates to a warning device interactive between a vehicle and the roadway upon which the vehicle travels to provide the driver with not only an audible, but a physical warning of the potential condition ahead.

2. Description of the Prior Art

The particular device disclosed herein is designed and adapted for use by construction crews which oftentimes find themselves working either adjacent to or on a roadway.

Most highway warning systems in present use rely upon visually perceivable characteristics, such as lights, flares, flags, signs, barriers, cones, lane markers and the like. These devices are usually constructed of a highly visible perceptive color in order to alert the driver that a condition exists which requires attentiveness and quite possibly a lowered speed.

The aforesaid warning systems are effective under ideal conditions, but lose their effectiveness under certain meteorological conditions which affect visibility. Still further, the aforesaid warning systems lose their effectiveness during dusk and evening time hours and may be susceptible to certain meteorological conditions which cause their destruction or misplacement. Still further, such systems may alert the driver to an approaching condition, but not fortify such a recognition so as to cause the driver to decrease speed.

The need exists for a warning device used in conjunction with the aforesaid warning signs which is easily transportable, stored, and easily positioned on the roadway during the hours in which constructions crews are working on the roadway or adjacent thereto and which can be removed easily when the work is completed for the day or when the work is completed and the work crew moves to a new location.

Construction crews desire a lightweight, portable warning system which is easily stored without occupying excessive space and which can be installed and secured quickly and easily and removed quickly and easily at the end of the day.

Attempts to provide this type of warning system can be found in U.S. Pat. No. 4,542,709 to Spaugh, which attempts to replicate a grooved highway surface as is found on certain concrete surfaces of highways to warn drivers of approaching toll booths. The shortcomings of Spaugh are that it is a two-piece mat in which the vertical uprights can be dislodged. It is also questionable as to whether or not the construction of Spaugh would have any warning effect for large vehicles, such as tandems and tractor trailers, and it does not appear that Spaugh secures the mat to the road surface in any manner such that it can be dislodged and moved by the operation of vehicles over the mat over a period of time.

Applicant's warning system meets the requirements of construction crews working adjacent to or on roadways and, at the same time, provides a means for securing the warning system in place so that it cannot be dislodged by vehicles passing over it. Further, Applicant's warning system provides not only an audible, but a physical warning system in the form of a slight vibration translated to the driver through the suspension system. This reinforces the warning to the driver to decrease the speed of the vehicle.

SUMMARY OF THE INVENTION

A highway warning system comprising a mat or mats having an elongated rectangular periphery characterized by a long length direction and a shorter width direction, the underside of the mat being substantially flat to conform to the surface of the roadway, the upper surface of the mat having an upward ramp portion on its leading edge, and a downward ramp portion on its trailing edge, and there being positioned therebetween, a plurality of wave-like formations defined by a wave height and a trough, the distance between wave heights corresponding to a chord dimension of the diameter of a wheel of a vehicle, the mats having a plurality of throughbores therethrough on the axis of its long length direction for the accommodation of a securing means in the form of a cable and spike arrangement for securing the mat in place to compliment the primary securing means, that being an adhesive secured to the underside of the mat member.

OBJECTS OF THE INVENTION

It is an object of the present invention to provide for a novel portable warning device for deployment upon a roadway of any surface characteristics to warn a driver of an approaching hazardous or work condition.

It is a still further object of the present invention to provide for a novel portable warning device which imparts not only an audible warning sound to the driver, but also a physical warning sound in the manner of a slight vibration transmitted through the suspension of the vehicle.

It is a still further object of the present invention to provide for a novel warning device for deployment upon a roadway which is lightweight, resilient, and easily installed and removed as necessary.

It is a still further object of the present invention to provide for a novel warning device for deployment upon a roadway which the warning device is easily stored without occupying excessive space.

BRIEF DESCRIPTION OF THE DRAWINGS

A fuller understanding of the nature and objects of the invention should be had particularly when taken with respect to the following detailed description when taken in conjunction with the accompanying drawings forming a part of this specification and in which the similar numerals of reference indicate corresponding parts of the figures of the drawings wherein.

DETAILED DESCRIPTION OF THE DRAWINGS

Figure 1:
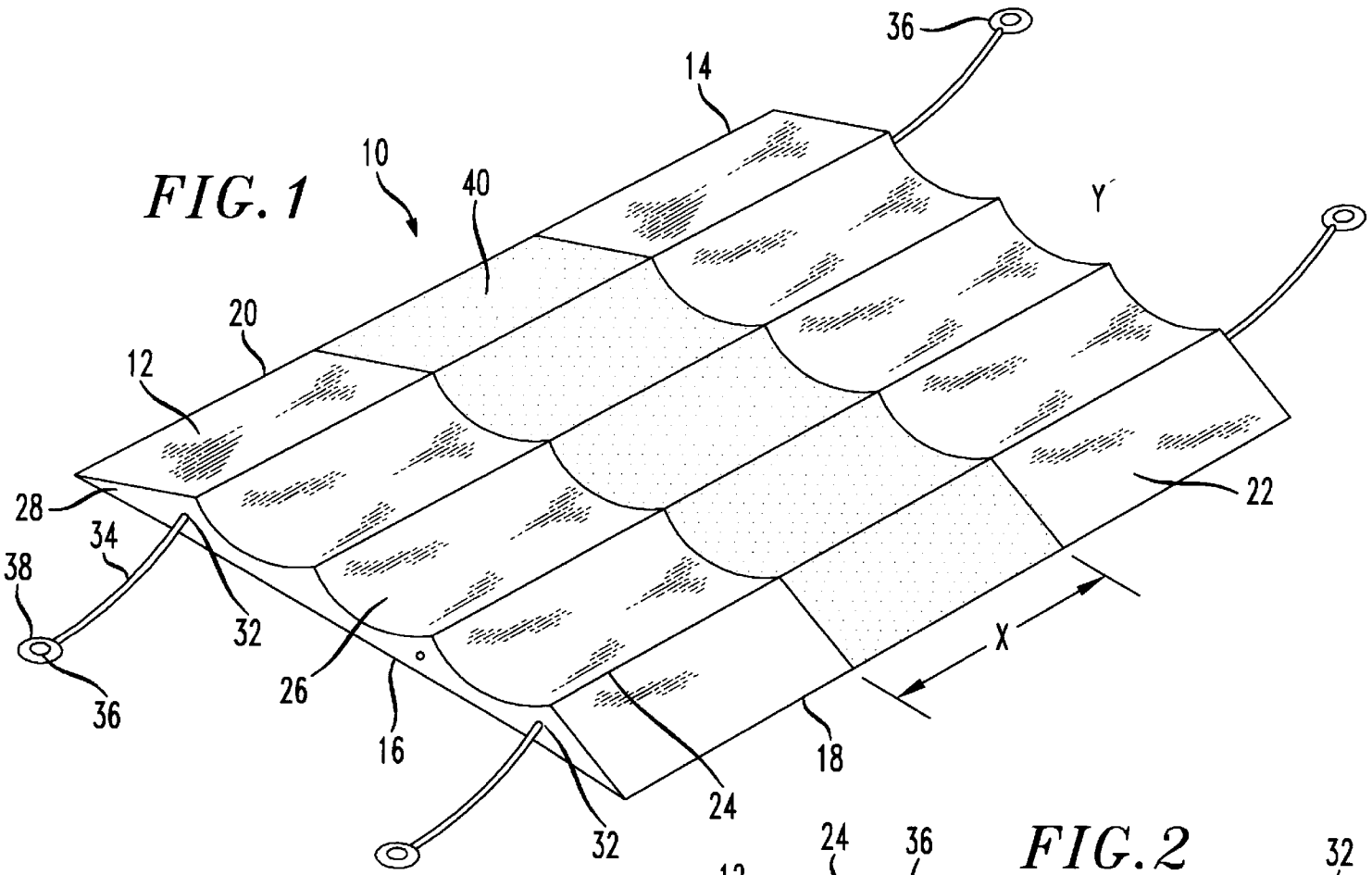
FIG. 1 is a perspective view of the highway warning system.

Referring to FIG. 1, there is illustrated a first embodiment of the highway warning system 10. Highway warning system 10 is comprised of a mat 12 constructed of flexible resilient material, such as rubber, Neoprene, ABS, a composite of recycled material or the like. Mat 12 has a generally rectangular periphery 14 whose length dimension X is greater than its width dimension Y. Mat 12 has a generally planar lower surface 16 for cooperation with and conforming to the surface of the roadway.

Figure 2:
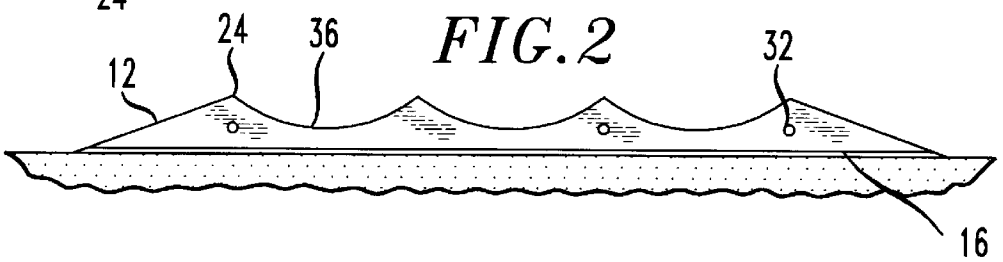
FIG. 2 is a side view of the highway warning system illustrating its relationship with the tire of a vehicle.

The leading edge 18 of mat 12 is sloped or inclined upwardly and the trailing edge 20 of mat 12 is sloped or inclined downwardly. Between leading edge 18 and 20, the upper surface 22 of mat 12 is comprised of a wave-like surface alternately presenting a wave cap 24 and a wave trough 26 which extend longitudinally across the length dimension X of mat 12. In such a construction, as illustrated in FIG. 2, mat 12 would have opposing end walls 28 and 30.

The length dimension X of warning system 10, as illustrated in the first embodiment, would be sufficient to span a lane of traffic so as to cause the sequential wave caps 24 and wave troughs 26 to engage both front wheels of a vehicle and subsequently, both rear wheels of the vehicle.

The preferred manner of securing mat 12 to a roadway would be by means of a temporary adhesive, either applied by spraying or coating the flat undersurface 16 of mat 12 prior to its placement on the road surface.

In addition to the manner of securing mat 12 to a roadway by means of adhesive, an additional, supplementary manner of securing the mat which could be used complimentary with the adhesive or alternatively without the adhesive would involve the positioning, longitudinally lengthwise through mat 12 of a plurality of throughbores 32 running between end walls 28 and 30. Through these throughbores could be extended a cable means 34 having a securing means in the form of an eye bolt 36 or the like positioned at each end. In this configuration, a construction worker positioning the mat on a lane of traffic could secure the mat in place by driving a temporary spike 38 through each of the eye bolts 36 to maintain the mat in position, the eye bolts being removed at the end of the workday and the mat being removed for repositioning at a subsequent time.

Mat 12 would be constructed of flexible resilient material which would be lightweight, yet wear retardant and which would allow the construction workers to remove and store the mat 12 without difficulty. A typical length of mat 12 in order to span a vehicular lane would be approximately 10 feet. A typical width of mat 12 may range from 2 to 4 feet.

As illustrated in FIG. 2, the distance between wave caps 24 and the arcuate nature of wave troughs 26 can be formed to correspond to and be complimentary to the partial circumference of the wheel of a motor vehicle as illustrated in FIG. 2. Further, the illustrations as set forth in FIGS. 1 and 2 show the highway warning system with four wave caps and three troughs. However, this number is one of design choice and will be recognized by one skilled in the art that the number of caps and troughs can be either reduced or extended.

In addition to the embodiment as illustrated in FIG. 1, the highway warning system mat 12 may also have a central portion positioned midway between end walls 28 and 30 which is substantially less thick than the portion of mat 12 proximate end walls 28 and 30. The central portion would not normally be contacted by the wheels of a motor vehicle and thus could have a relatively flat upper surface which would aid in the moving and storage of mat 12 by allowing it to be folded over upon itself, the central flat portion 40 functioning much like a hinge to allow mat 12 to be stored in less space.

Figure 3:
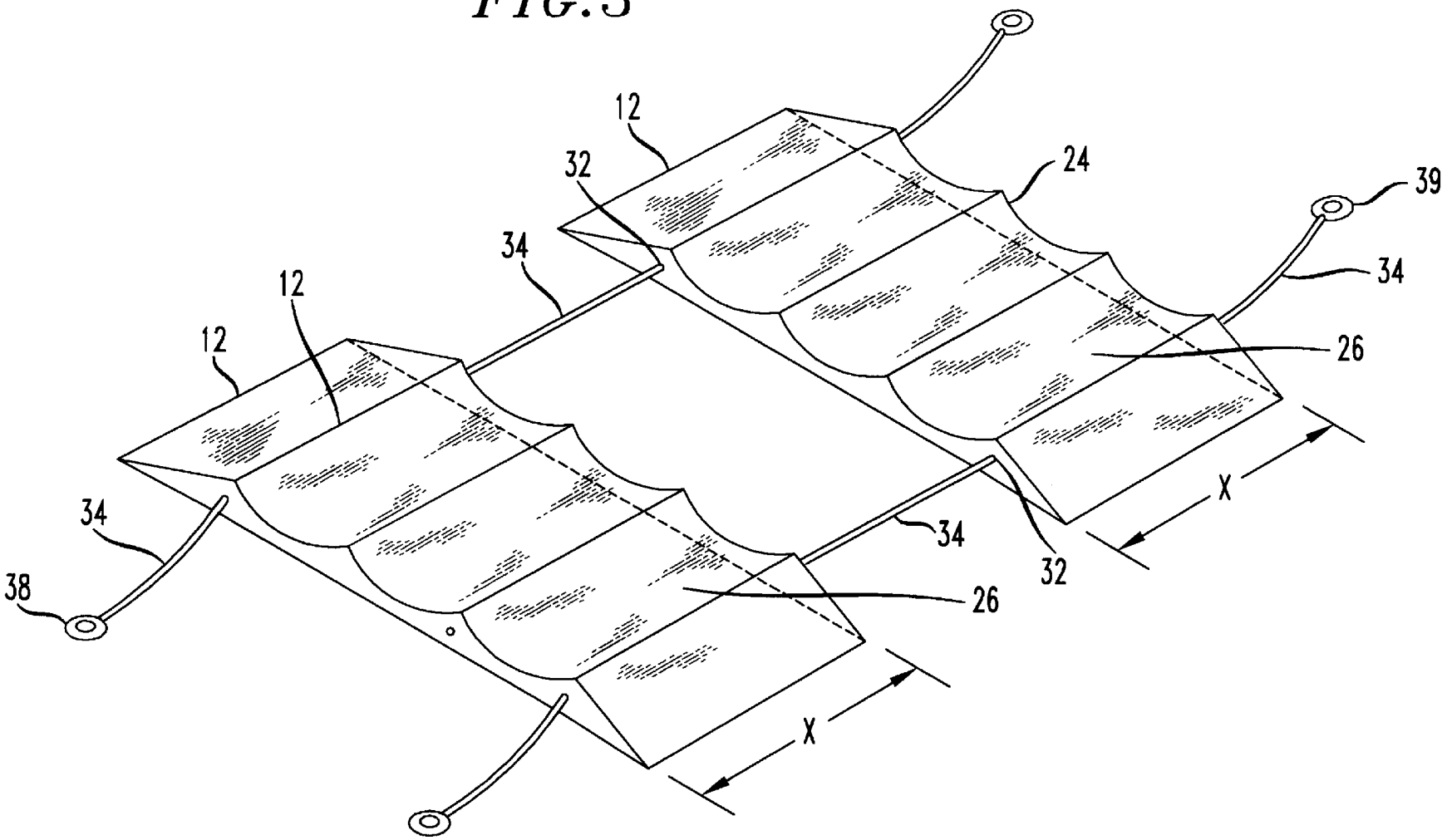
FIG. 3 is a second embodiment of the highway warning system illustrating an even lighter and more portable version of the warning system.

A second embodiment of the highway warning system is illustrated in FIG. 3. In FIG. 3, instead of having one contiguous mat 12 spanning the width of a vehicular lane, two separate mats of the same design construction would be utilized; however, their longitudinal axis length X would be reduced so as to allow the positioning of the two mats in the tire tracks associated with a vehicular lane of traffic. In this configuration, the same wave cap and wave trough configuration would be associated with each mat and the throughbores 32 would be associated with each mat. The cable 34 would extend through both mats and be secured at each end by spike 38. However, the mats would be maintained in position by means of a lock nut or the like configured on the cables between the two identical mats 12, the lock nut acting as a spacer element to maintain the mats 12 in the tire track of the particular vehicular lane of traffic in which it is positioned. It will be recognized by one of ordinary skill in the art that other means may be used in the second embodiment to maintain the position of the mats, such as a collar or skirt extending between opposing throughbores on mats 12 in order to maintain their distance apart and their positioning in the tire lane.

The second embodiment of the highway warning system, as illustrated in FIG. 3, is more suitably adapted to ease of installation and ease of transportation and storage because of its reduced weight and volume.

While the present invention has been described in connection with the exemplary embodiments thereof, it will be understood that many modifications will be apparent to those of ordinary skill in the art and the application is intended to cover any adaptations or variations thereof. Therefore, it is manifestly intended that this invention be only limited by the claims and the equivalents thereof.

What is claimed is:

1. A portable highway warning device comprising:

a mat having a substantially flat lower surface and an upper surface, said mat fabricated of a flexible resilient composition having an elongated rectangular periphery characterized by a long length direction having a leading edge and a trailing edge and a short length direction defined by two end panels, said upper surface of said mat having an undulated surface defined by a plurality of wave crests and a plurality of wave troughs positioned between said wave crests, the transition from said wave crest to said wave trough to said adjacent wave crest characterized by a curved incline, said curved incline on said leading edge of said mat defining an up ramp to said mat and said curved incline on said trailing edge of said mat defining a downward incline from said mat, said undulating upper surface and said flat lower surface extend from said opposing end panels in said long length direction, terminating a distance apart on said long length direction thereby enabling said mat to be folded in half so that said lower surfaces of said halves are in abutment, whereby:

when said mat is placed on said road surface with said lower surface in contact with said road surface and said length direction oriented transversely to the direction of vehicular t ravel, passage of the wheels of a vehicle across said mat and said undulating upper surface produces a discernible audible sound and a discernible vibration to the vehicle operator.

2. The portable highway warning device in accordance with claim 1 wherein said mat is secured to said road surface by means of an adhesive applied to the lower surface of said mat.

3. The portable highway warning device in accordance with claim 1 wherein the arc defined from said wave crest to said wave crest on said mat corresponds to the partial arc of circumference of the tire of said vehicle.

4. The portable highway warning device in accordance with claim 1 wherein said mat has a plurality of throughbores in said mat in the long length direction extending between said end panels for receipt of one or more cables extending through said throughbores and cooperable with a ground engagement device to secure said mat transversely on said roadway.

5. The portable highway warning device in accordance with claim 1 wherein said mat is characterized by having a long length direction sufficient for said mat to be positioned on said road surface transversely to engage one lateral set of vehicular wheels, said mat used in conjunction with a second mat positioned transversely in said roadway in a position sufficient to engage said opposing lateral set of vehicular wheels.

* * * * *